US005195292A

United States Patent [19]

Bedics

[11] Patent Number: 5,195,292

[45] Date of Patent: Mar. 23, 1993

[54] RESILIENTLY MOUNTED RIGID FLOOR GRATING

[75] Inventor: Michael A. Bedics, Poughquag, N.Y.

[73] Assignee: Pawling Corporation, Pawling, N.Y.

[21] Appl. No.: 628,218

[22] Filed: Dec. 17, 1990

[51] Int. Cl.[5] ..... E04F 15/00; E04C 2/42

[52] U.S. Cl. ..... 52/664; 52/227; 52/177

[58] Field of Search ..... 52/664, 177, 227, 228, 52/473; 119/9, 28

[56] References Cited

U.S. PATENT DOCUMENTS

| | | | |
|---|---|---|---|
| 972,482 | 10/1910 | Stockford | 52/177 |
| 2,686,344 | 10/1948 | Van Dé Veer . | |
| 3,383,822 | 5/1968 | Viehmann et al. . | |
| 3,703,059 | 11/1972 | Kessler | 52/177 |
| 3,808,628 | 5/1974 | Betts . | |
| 3,913,291 | 10/1975 | Dulien et al. | 52/177 |
| 3,983,668 | 10/1976 | Hassman | 52/177 |
| 4,027,451 | 6/1977 | Bustin | 52/664 |
| 4,522,009 | 11/1985 | Fingerson | 52/177 |
| 4,727,704 | 3/1988 | Carlton . | |
| 4,771,586 | 9/1988 | Schmidt | 52/664 |
| 4,897,299 | 1/1990 | Kawachi et al. | 52/664 |
| 4,903,444 | 2/1990 | Berndt, Jr. . | |
| 4,928,471 | 5/1990 | Bartley | 52/664 |

*Primary Examiner*—David A. Scherbel
*Assistant Examiner*—Michele A. Van Patten
*Attorney, Agent, or Firm*—Schweitzer Cornman & Gross

[57] ABSTRACT

A resiliently mounted and constructed rigid floor grate assembly is disclosed, in which a series of metallic tread rails of T-shaped cross section, placed side by side and connected by tie rods, are separated by individual, resilient spacing and supporting elements. The spacing and support elements are placed between each pair of tread rails, underneath the tread portions thereof, and are held under compression by the tie rods to form a rigid assembly. In addition, the height of the spacing and support elements is slightly greater than the height of the vertical web portions of the tread rails, to support the metallic elements slightly above the hard surface of a floor recess in which the grate assembly is placed. Significantly reduced metallic noise and clatter is an important benefit.

5 Claims, 1 Drawing Sheet

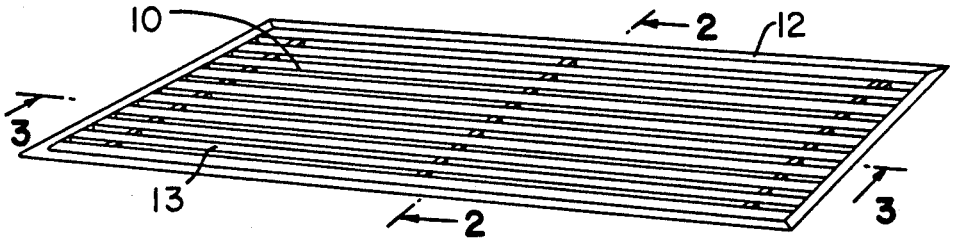
FIG. 1
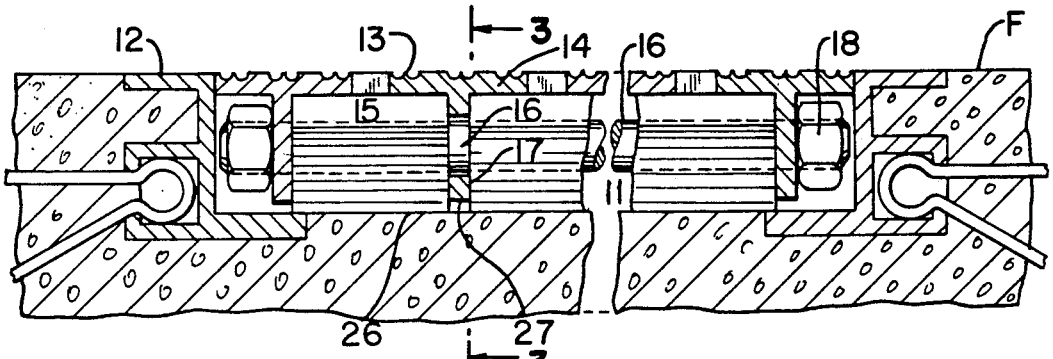
FIG. 2
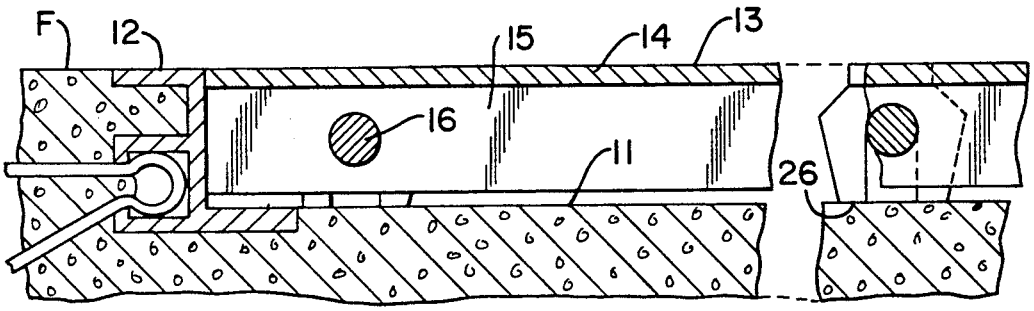
FIG. 3
FIG. 4
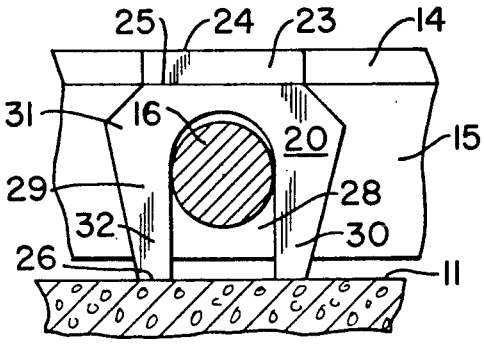
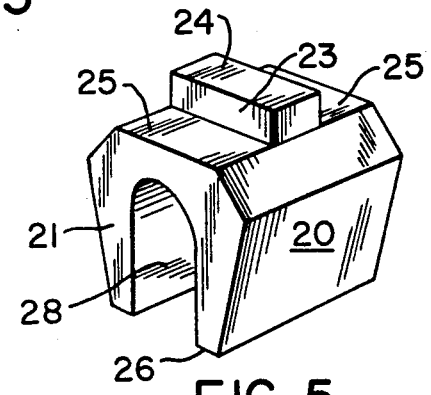
FIG. 5

RESILIENTLY MOUNTED RIGID FLOOR GRATING

BACKGROUND AND SUMMARY OF THE INVENTION

The present invention relates to floor gratings, such as are commonly installed at building entrances and the like to provide means for removal of dirt, water and other foreign materials from the footwear of persons transiting the grating. Entrance gratings, as distinguished from entrance mats, typically are of rigid construction, and those of modern design frequently are assembled of a series of spaced-apart tread rails, secured together in side-by-side relation to form a rigid structure. Such grating structures typically are placed in a shallow recess, formed in the entrance flooring or walkway, so that the surface of the grating is flush with the surrounding floor.

A variety of structures are known and commercially available for use as rigid entrance grating. Representative of some of these are structures disclosed in the following prior U.S. Pat. Nos.: Berndt, Jr. No. 4,903,444, Carlton No. 4,727,704, Reifsnyder No. 4,112,640, Nagin No. 3,469,359, and Viehmann et al 3,383,822. Each of these discloses a grating structure comprised of a plurality of tread rails or the like arranged in a parallel, side-by-side relation and secured by a plurality of connecting elements extending at right angles to the tread rails and typically passing through openings in the tread rails. In many cases, the tread rails are arranged in closely spaced relation, so that a series of side-by-side tread rails forms an effectively substantially continuous surface for the support of common footwear, including high heeled shoes. At the same time, openings are available for the passage of debris, which is collected in the recess, below the top surface of the grating. Quite typically, these structures are formed of a light weight, extrudable metal, such as aluminum.

Although known designs of floor gratings are functionally adequate for many purposes, many of them tend to be unpleasantly noisy. Thus, in a typical case, aluminum tread rails are joined together by aluminum connecting elements, and the entire assembly is placed within a recess in a hard flooring, such as concrete, terrazzo or the like. When this structure is stepped on, disconcerting noise and clatter may be produced by the metallic elements moving relative to the hard flooring and/or relative to other, contacting metallic elements. This noise can be damped by the use of resilient pads, as in the case of the Berndt, Jr. U.S. Pat. No. 4,903,444. However, the sound-creating and sound-transmitting character of the metallic structure remains.

In accordance with the present invention, a novel and improved metallic floor grating, or rigid construction, is assembled in a manner that spacing of the tread rails is effected by special resilient spacing and support elements. These elements serve in a novel way to not only maintain the individual tread rails in a desired, closely spaced-apart relation, but also to support the tread rails slightly above the floor of the recess in which the grate structure in installed.

In a preferred embodiment, a plurality of metallic tread rails are joined together by means of connecting elements, typically tie rods, extending at right angles thereto. Between each adjacent pair of tread rails and associated with each connecting element is a resilient spacing and support element. In the complete assembly, the spacing and support elements are maintained under compression by the connecting elements, for form a rigid grate structure. To advantage, each of the spacing and support elements is formed with an opening or recess, arranged to receive the connecting element with which it is associated.

For a more complete understanding of the above and other features and advantages of the invention, reference should be made to the following detailed description of a preferred embodiment and to the accompanying drawings.

DESCRIPTION OF THE DRAWINGS

FIG. 1 is a perspective view of a typical floor grating installation utilizing a grating structure of the invention.

FIGS. 2 and 3 are a fragmentary cross sectional views of the structure of the invention, as taken generally along lines 2—2 and 3—3 respectively of FIG. 1.

FIG. 4 is an enlarged cross sectional view showing an end elevational view of a spacing and support element incorporated in the structure of FIG. 1.

FIG. 5 is a perspective view of the spacing and support element of FIG. 4.

DESCRIPTION OF PREFERRED EMBODIMENT

Referring now to the drawing, the reference numeral 10 designates generally a rigid floor grating structure, to be described further, which is received in a shallow recess 11 formed in a concrete or terrazzo flooring F, for example. In a typical installation, the well or recess 11 may be of rectangular outline and of a suitable depth, for example about 13/16 ths inch. The length and width dimensions of the recess may be widely varied to suit the particular entrance or other installation. Typically a frame or border structure, comprising embedded frame elements 12, is installed prior to pouring of the flooring material.

The rigid grate structure is comprised of a plurality of closely spaced-apart tread rails 13, which extend the full width of the grate structure. Each of the rails 13 is formed to provide an upper, generally flat and horizontally oriented tread portion 14 and a vertically extending web portion 15. As reflected particularly in FIG. 2, the tread rails 13 preferably are of T-shaped cross section, with the vertical webs being symmetrically located with respect to the upper tread portions. The tread portions 15 advantageously are corrugated or otherwise roughened for slip resistance, and optionally may include tread inserts (not shown) of carpet material, elastomeric material, or the like.

Although specific dimensions do not form a part of the invention, a typical tread rail element 13 may have a tread width of about 0.8 inch, and adjacent tread portions may be spaced apart a distance of about 3/16 ths inch. The tread rails advantageously are extruded lengths of aluminum, having a thickness of about ⅛ th inch.

A series of tread rails 13, sufficient in number to form a grate structure of the desired length, is arranged in parallel relation and joined by means of a plurality of laterally spaced connecting elements 16. These beneficially may be elongated tie rods, formed of aluminum and threaded at one end, and preferably at both ends. The tie rods 16 are inserted through openings 17 formed in the tread rail webs 15, and are dimensioned to extend from one end of the grate structure to the other, through each of the webs 15, and to be engaged by a nut 18 at each end. The tie rods 16 are spaced apart laterally across the width of the grate structure. At least two such tie rods will be provided in any case, and in typical grate structures having a width dimension of several feet, tie rods will be provided at spacing intervals of, for example, every 12 to 18 inches across the width.

Pursuant to the invention, there is positioned between each adjacent pair of tread rails 13 a plurality of spacing and support elements 20 formed of a tough, resilient material, such as high density polyethylene, or other resilient plastic or elastomeric materials. Preferably, the spacing and support elements 20 are of molded construction and the materials chosen for their formation are thus selected to be suitable for molding, as well as possessing the structural and resiliency characteristics desired.

As shown in FIGS. 4–6, the spacing and support elements 20 are of generally rectangular outline when viewed from the top. The length and height dimensions of the elements 20 are significant, in relation to the dimensions of the tread rails 13, in order to maintain adjacent tread rails in properly spaced-apart relation and in order to elevate the rails properly above the bottom surface of the floor recess 11. For example, for use with a T-shaped tread rail having a tread width of 0.8 and a web thickness of about ⅛ th inch, the length of the spacing and support element may suitably be 0.863 inch. When the spacing and support elements 20 are placed between adjacent tread rails 13, with the opposite end faces 21 of the elements 20 engaging vertical web portions 15 of the tread rails, adjacent rails are separated by approximately 3/16 ths inch.

Desirably, each spacing and support element 20 is provided on top with a centrally disposed, upwardly projecting lug 23 whose width is approximately 3/16 th inch, equal to the desired spacing between adjacent rails, and whose height is approximately equal to the thickness of the tread portions 14 of the tread rails 13. Accordingly, when the spacing and support elements are properly positioned between adjacent tread rails 13, the lugs 23 project upward between the edges of adjacent tread portions 14 to a level such that the lug top surfaces 24 are substantially flush with the upper surfaces of the tread portions.

In the illustrated form, the spacing and support elements 20 are provided with an upwardly facing support surface 25, which is generally flat and extends from one end to the other of the element 20, interrupted in the center by the projecting lug 23. The height of the spacing and support elements, as measured from bottom surfaces 26 to the upwardly facing support surface 25, is greater than the height of the tread rail web portions 15 by a predetermined amount, sufficient to support the web portions above the hard surface of the recess 12 when the grate structure is at rest and/or subjected to normal traffic loads. For example, using spacing and support elements 20 formed of molded high density polyethylene, in conjunction with tread rails 13 having web portions 15 of about 0.6 inch in height, the height of the elements 20 advantageously is about 11/16 ths inch, so as to support the bottom edges 27 of the web portions above the surface of the floor recess 11 by approximately 1/16 th inch.

The normal supported elevation of the web portions 15 is such that the web portions do not contact the floor recess 11 under normal traffic loads. At the same time, if extraordinary loads are experienced, the web portions 15 will "bottom out" against the floor recess 11 without excessive downward displacement. This avoids imparting excessive stresses to the tread rails 13 and time rods 16 and also makes the maximum displacement of structure barely noticeable to the traffic passing over it.

In the illustrated form of the invention, each spacing and support element 20 is provided with a downwardly opening recess 28 dividing the lower portions of the element into spaced-apart leg portions 29, 30. The recess 28 is of a width to closely receive a tie rod 16 of about ⅜ th inch diameter, and the upper end of the recess is of semicircular contour to pass around the top of the tie bar with sufficient clearance to facilitate easy assembly. As shown in FIG. 4, the leg portions 20, 30 may taper somewhat in thickness from shoulder portions 31 (approx. ¼ th inch) to their lower extremities 32 (approx. ⅛ th inch). Desirably, the elements 20 also taper convergently somewhat from the shoulder regions 31 to the upper support surface. One result of this is to facilitate passage of debris through the openings in the grate, and also to reduce visual exposure of the support elements from above the grating structure.

When the grating structure is assembled, the desired number of tread rails 23 is arranged in a suitable assembly jig, with the rails located in an approximate spacing, slightly greater than the desired final spacing. The spacing and support elements 20 are then placed in their approximate positions, and the tie rods 16 are inserted through the aligned openings 17 in the tread rails and through the aligned recesses in the elements 20. When the nuts 18 at one or both ends of the tie rods are tightened, the entire assembly is compressed and rigidified, with adjacent tread rails 13 being rigidly positioned and properly spaced apart by the intervening spacing and support elements 20.

The construction of the invention significantly reduces the noise and "clatter" that is often associated with aluminum floor grating structures as a result of the metal-to-metal contact between elements of the structure and also the metal to concrete or terrazzo contact between the structure and its support. By utilizing elements of a suitable polymeric or elastomeric material, such as molded high density polyethylene, to maintain the tread rails is the desired, spaced-apart relation, metal-to-metal contact is minimized and noises from that source are practically eliminated. Equally important, the tread rails are kept from contacting the hard support surface during normal usage, and metallic noises from that source are effectively prevented. Furthermore, by maintaining the somewhat resilient polymeric spacing elements in tight contact with the tread rails, externally initiated clatter, such as might result from hard shoe soles or heels contacting the metal tread surfaces, are attenuated and damped and thus kept at an acceptably low level.

The individual spacing and support elements are ideally manufactured by injection molding but could in appropriate cases, by eliminating the upwardly projecting lug 23, be produced by extrusion. Molded elements are greatly to be preferred, however, because of the need for reasonable precision and uniformity in the length dimension of the elements.

In the structure of the invention, although the rigid grate assembly is normally supported above the hard surface of the recess 11, the amount of the elevation is kept at a minimum, sufficient to maintain separation under typical loading. Under excessive loads, however, the metallic grate structure quickly bottoms against the rigid floor surface to provide support against distortion of the grate elements or excessive displacement of the grate in relation to the surrounding floor surface.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A resiliently mounted and constructed rigid floor grate assembly which comprises, (a) a plurality of rigid metallic tread rails arranged in side-by-side, spaced apart relation, (b) said tread rails having upper tread portions forming an effectively substantially continuous grating surface provided with regularly spaced openings between adjacent tread rails for the passage of foreign materials, (c) said tread rails further having integral web portions projecting downwardly from said tread portions, (d) the tread portions of said tread rails having side edges and said downwardly projecting web portions being located inwardly from at least one of said side edges, (e) a plurality of spaced apart connecting elements extending at right angles to said tread rails, (f) said connecting elements being positioned beneath said tread portions and passing through openings formed in said web portions, and (g) a plurality of resilient spacing and support elements associated with said connecting elements and extending between adjacent web portions of each pair of adjacent tread rail members, (h) said spacing and support elements serving to retain said tread rail members in uniformly spaced-apart relation to each other, (i) said spacing and support elements having upwardly facing upper surface portions engaging and supporting downwardly facing surface portions of said tread portions, (j) the vertical height of said spacing and support elements being at least slightly greater than the height of said web portions, whereby the lower edges of said web portions are supported in elevated relation to the surface on which said grating is placed, (k) said spacing and support elements each having an opening therein extending from one end to the other and receiving said connecting elements, (l) said openings being of a size and shape to accommodate unresisted downward movement of said connecting elements relative to said openings.

2. A floor grate assembly according to claim 1, further characterized by (a) the openings in said spacing and support elements being in the form of downwardly opening, inverted U-shaped recesses.

3. A floor grate assembly according to claim 1, further characterized by (a) said spacing and support elements being provided with lug portions extending upwardly from the upper surfaces thereof between the adjacent side edges of adjacent tread rail elements, (b) the height of said lug portions being substantially equal to the thickness of said tread portions whereby the upper surfaces of said lug portions are substantially flush with the upper surfaces of said tread portions.

4. A floor grate assembly according to claim 1, further characterized by (a) said tread rail members being of generally T-shaped cross section and having centrally disposed downwardly extending web portions, and (b) said spacing and support elements extending between adjacent web portions and underneath the tread portions of adjacent tread rail elements.

5. A floor grate assembly according to claim 1, further characterized by (a) said connecting elements comprising rod-like elements having a threaded portion on at least one end and being of a length to extend slightly beyond the tread rail web portions at each end extremity of said grate assembly, (b) a fastening nut mounted on the threaded portion of each connecting element and placing said spacing and support elements in compression.

* * * * *